US006695686B1

(12) United States Patent
Frohlich et al.

(10) Patent No.: US 6,695,686 B1
(45) Date of Patent: Feb. 24, 2004

(54) METHOD AND DEVICE FOR GENERATING A TWO-PHASE GAS-PARTICLE JET, IN PARTICULAR CONTAINING $CO_2$ DRY ICE PARTICLES

(75) Inventors: Hans Frohlich, Dollnitz (DE); Sabine Gebhardt, Mark-Kleeberg (DE); Berthold Trampusch, Solingen (DE)

(73) Assignee: L'Air Liquide Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/622,708

(22) PCT Filed: Feb. 19, 1999

(86) PCT No.: PCT/EP99/01047

§ 371 (c)(1),
(2), (4) Date: Dec. 4, 2000

(87) PCT Pub. No.: WO99/43470

PCT Pub. Date: Sep. 2, 1999

(30) Foreign Application Priority Data

Feb. 25, 1998 (DE) ..... 198 07 917

(51) Int. Cl.[7] ..... B24C 5/04
(52) U.S. Cl. ..... 451/102; 239/433; 239/434
(58) Field of Search ..... 451/36, 39, 40, 451/102; 239/433, 434

(56) References Cited

U.S. PATENT DOCUMENTS 4,067,150 A * 1/1978 Merrigan ..... 451/99
5,035,090 A * 7/1991 Szucs ..... 451/102
5,184,427 A 2/1993 Armstrong
5,335,459 A * 8/1994 Dale ..... 451/102
5,366,560 A 11/1994 Rubey, III et al.
5,405,283 A * 4/1995 Goenka
5,462,605 A * 10/1995 Szucs ..... 134/7
5,910,042 A * 6/1999 Niechcial
6,283,833 B1 * 9/2001 Pao et al. ..... 451/40

FOREIGN PATENT DOCUMENTS

| | | |
|---|---|---|
| DE | 40 02 787 | 8/1991 |
| EP | 0 582 191 | 2/1994 |
| FR | 2 627 121 | 8/1989 |

* cited by examiner

*Primary Examiner*—M. Rachuba
(74) *Attorney, Agent, or Firm*—Burns, Doane, Swecker & Mathis, L.L.P.

(57) ABSTRACT

The present invention relates to a method and a device for generating a two-phase gas-particle jet for treating surfaces by means of particles, in particular $CO_2$ dry ice particles (22), using a two-phase gas-particle jet. To this end, the $CO_2$ dry ice particles (22) are fed with a, tangential flow to a blasting chamber (30) in such a manner that the $CO_2$ dry ice particles (22) are forced into a rotational movement about an axis of flow (50), the angular velocity of this rotational movement then being increased in the direction of flow by means of a blasting nozzle (40), so that maximum speeds occur in the blasting-nozzle outlet (42). The two-phase gas-particle jet emerging from the blasting-nozzle outlet (42) is formed in such a way that the solid-phase $CO_2$ dry ice particles (22) are arranged in a uniform ring shape with an enlarged external diameter. The invention achieves in particular a considerable rise in the surface power when cleaning surfaces by means of $CO_2$ dry ice particles (22).

15 Claims, 2 Drawing Sheets

METHOD AND DEVICE FOR GENERATING A TWO-PHASE GAS-PARTICLE JET, IN PARTICULAR CONTAINING $CO_2$ DRY ICE PARTICLES

BACKGROUND OF THE INVENTION

1. Field of the Invention

The present invention relates to a method and a device for generating a two-phase gas-particle jet for treating surfaces by means of particles, in particular $CO_2$ dry ice particles 2. Description of the Related Art It is known that it is possible to clean surfaces by means of a compressed-gas jet, in particular compressed air, to which particles, for example of $CO_2$ dry ice, have been admixed. The explanations given below relate to the use of dry ice particles, but can equally well be transferred correspondingly o other particles. The cleaning action is effected by She abrasive action of the particles and, in the case of dry ice particles, also by the cooling action of the $CO_2$ dry ice particles which have been accelerated by the compressed-gas stream. On impacting on the surface to be cleaned, these dry ice particles transmit kinetic energy, and on this impact they break up into smaller fragments and sublime either on this impact or immediately afterwards, extracting heat from the surface, in addition to the cold-gas/particle mixture stream. The blasting agent, that is to say the $CO_2$ dry ice particles, sublimes without leaving a residue. At most, loose particles from the former surface layer or surface contaminants remain on the surface to be cleaned, and these particles are deep-cooled and brittle, and can therefore be removed easily. In general, the surfaces are cleaned in such a manner that the surface particles removed are blown completely away from the surface during the blasting operation and are then collected by mechanical or pneumatic means.

It is known to generate the two-phase stream of compressed gas and solid $CO_2$ dry ice particles by means of two fundamentally different methods:

In a first method, the $CO_2$ dry ice particles are admixed with the compressed gas by means of an ejector, which Is known for example from U.S. Pat. No. 4,707,951, or a star feeder, and are then fed to a movable blasting nozzle via a common hose line. The ejector is designed in such a manner that the pressure nozzle ends with a minimum diameter in the axial region of the inlet funnel for the $CO_2$ dry ice particles. The ejector method has the drawback that it is only possible to achieve relatively low particle velocities at the blasting nozzle, a fact which represents a severe limitation to the cleaning performance. Although the star-feeder method generates considerably higher particle velocities, owing to the possibility of setting higher gas pressures in the two-phase mixture, it has the drawback that firstly sealing problems on the star feeder may lead to disruption and, secondly, the action of the compressed gas means that sublimation losses inside the transport hose and into the blasting nozzle are high. These drawbacks impair the reliability and performance of the star-feeder method and increase process costs.

In a second method, compressed gas and $CO_2$ dry ice particles are fed to a blasting gun with a directly connected blasting nozzle using the so-called two-hose method, i.e. via two separate hose lines. The blasting gun which is known, for example, from DE-195 44 906 A1 or U.S. Pat. No. 5,520,572 is in this case configured in the form of an ejector in such a manner that the compressed gas is guided through a high-pressure nozzle arranged axially with respect to the blasting nozzle, with the result that a reduced pressure is generated inside the blasting gun. In this case, a feed line for the $CO_2$ dry ice particles is arranged radially and at an angle to the blasting nozzle, through which line these $CO_2$ dry ice particles are sucked in and admixed to the gas jet, owing to the reduced pressure which is generated, it being necessary for the blasting nozzle, which is arranged directly on the blasting gun, to have a defined minimum length, so that the $CO_2$ dry ice particles can be accelerated to a sufficiently high particle velocity.

SUMMARY OF THE INVENTION

The object of the invention consists in designing the surface treatment, in particular the cleaning, by means of particles, in particular $CO_2$ dry ice particles, to be more efficient, i.e. to develop a method for generating a two-phase gas-particle jet and a device for treating surfaces using the two-phase gas-particle jet, which in particular increase the surface performance when treating surfaces by means of $CO_2$ dry ice particles, make the cleaning process unsusceptible to problems and improve its technological reproducibility.

This object is achieved by means of a method for generating a two-phase gas-particle jet for treating surfaces by means of particles, in particular $CO_2$ dry ice particles, in which the $CO_2$ dry ice particles are fed with a tangential flow to a blasting chamber having an axis of flow, in such a manner that the $CO_2$ dry ice particles are forced into a rotational movement about the axis of flow, and in which the angular velocity of this rotational movement is then increased in the direction of flow by means of a blasting nozzle.

The method according to the invention is distinguished by the fact that a pure compressed-gas stream and a second stream which contains $CO_2$ dry ice particles are each fed to the blasting chamber separately via at least one compressed-gas feed line and via at least one particle-stream feed line, respectively, and are combined in the said blasting chamber in such a manner that the two-phase gas-particle jet is produced.

The abovementioned object is thus preferably achieved using the two-hose method described at the outset, in which a pure compressed-gas stream and a stream containing $CO_2$ dry ice particles are fed to a blasting chamber in respectively separate feed lines and are combined therein, so that a two-phase gas-particle jet with an axis of flow is formed, the $CO_2$dry ice particles being fed to the blasting chamber with a tangential flow in such a manner that the $CO_2$dry ice particles are forced into a rotational movement about the blasting axis and that the angular velocity of this rotational movement is then increased in the direction of flow by means of a blasting nozzle.

Furthermore, the method according to the invention is configured in such a way that the rate at which the $CO_2$ dry ice particles flow into the blasting chamber is configured to a maximum, by making the stream which contains $CO_2$ dry ice particles a rapid compressed carrier-gas stream in at least one particle-stream feed line from a particle reservoir to the blasting chamber, and by the fact that the compressed carrier-gas component contributes, with a rotational movement in the same direction, to the formation of the two-phase gas-particle jet.

In a preferred form, the device according to the invention for treating surfaces by means of particles, in particular $CO_2$ dry ice particles, using a two-phase gas-particle jet, has at least one turbostub for the supply of gas and/or particles, which is arranged on the housing of the blasting chamber and leads tangentially into the blasting chamber and has an additional axial alignment in the direction of the outlet of the boasting nozzle, the blasting nozzle being provided with an essentially conical inlet, the inlet angle of which is in total less than 120°, in particular less than 90°, preferably approximately 60°.

Advantageous configurations and refinements are given in the dependent claims. Accordingly, in an advantageous configuration the device is designed in such a manner that the blasting chamber is of cylindrical design in the region of the entry of the turbostub, the axial length of the blasting chamber corresponding to at least the diameter of the turbostub, preferably at least three times its diameter, and the internal diameter of the blasting chamber corresponding to at least 1.5 times the diameter of the turbostub, in particular approximately twice its diameter.

In particularly advantageous configurations of the device according to the invention, the compressed-gas feed line and the particle-stream feed line are produced parallel to one another from solid material over a length of 0.3 to 3 m, preferably approximately 1.5 m, with the axes of the feed lines being made either straight or bent.

Furthermore, the device is advantageously configured in such a way that the reservoir for the $CO_2$ dry ice particles is connected to a ultrasonic transport ejector, the inlet funnel housing of which is connected to a compressed carrier-gas feed line for compressed carrier-gas which is at a relatively high pressure, and to an outlet stub connected by means of a hose to the blasting chamber, and has approximately the same nominal width, in which case the compressed carrier-gas feed line is connected to a convergent/divergent compressed carrier-gas ultrasonic nozzle, the outlet of which ends at the wall of an end chamber at the end of the inlet funnel housing, the internal diameter of the end chamber preferably corresponding to 1 to 3 times the nominal width of the outlet stub.

The advantages of the invention consist in a considerable increase in the surface performance when cleaning surfaces by means of $CO_2$ dry ice particles, in the operating procedure being stabilized and in better reproducibility. Moreover, it has been found that the device according to the invention surprisingly makes it possible to use in a reliable manner dry ice particles which have a very large diameter, even of greater than 4 mm, with the result that new applications, in particular for the removal of relatively thick surface layers, can be realised. The solution according to the invention reduces the costs of surface treatment considerably and, if it is incorporated in blasting guns, reduces the physical strain on the operator when handling such devices.

BRIEF DESCRIPTION OF THE FIGURES OF THE DRAWING

Additional details and further advantages will be described below with reference to a preferred exemplary embodiment, in conjunction with the attached drawings, in which.

DETAILED DESCRIPTION OF THE PREFERRED EMBODIMENTS

Figure 1:
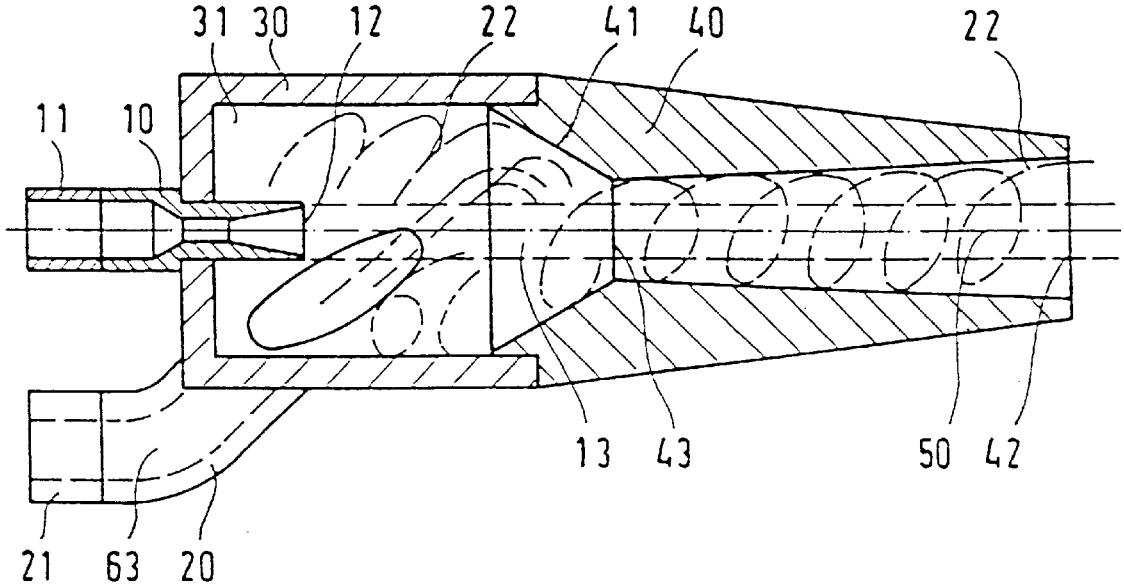
FIG. 1 shows a device for surface treatment in longitudinal section.

The device illustrated in FIG. 1 for treating surfaces by means of particles, in particular $CO_2$ dry ice particles, using a two-phase gas-particle jet comprises a blasting chamber 30, which is equipped with a compressed-gas feed line 11 for a compressed gas, preferably compressed air, nitrogen or $CO_2$ and at least one particle-stream feed line 21 for $CO_2$ dry ice particles. The compressed-gas feed line 11 is connected to a convergent/divergent compressed-gas ultrasonic nozzle 10 which is inserted axially centrally into the blasting chamber 30. The particle-stream feed line 21 is connected to a turbostub 20, which leads tangentially into the housing 31 of the blasting chamber 30 and preferably has an additional axial orientation of 45° in the direction of the outlet 42 of a blasting nozzle 40. The blasting nozzle 40 has an essentially conical inlet 41, which may also be slightly curved, preferably convergent, or conically reduced, in which case it is intended that the inlet angle should overall be less than 120°, in particular less than 90°, preferably 60°. This inlet angle is formed by the internal diameter of the blasting-chamber housing 31 and the neck diameter 43 of the blasting nozzle 40 over the length of the inlet 41 in the direction of the axis of flow 50. The blasting chamber 30 has a cylindrical region at the opening of the turbostub 20, the axial length of which cylindrical region corresponds to at least the diameter of the turbostub 20, preferably to at least three times its diameter. The internal diameter of the blasting chamber 30 is at least 1.5 times the diameter of the turbostub 20, in particular approximately twice its diameter. The compressed-gas ultrasonic nozzle 10 is configured, for example, for a compressed-gas pressure of 15 bar, and for a flow rate of 350 $m^3/h$ has a minimum diameter of 6.5 mm and, from the compressed-gas ultrasonic nozzle outlet 12, has a diameter of 11 mm. The compressed-gas ultrasonic nozzle outlet 12 of the compressed-gas ultrasonic nozzle 10 is positioned approximately at the level of entry of the turbostub 20.

The $CO_2$ dry ice particles 22, which are fed into the interior of the blasting chamber 30 with a tangential flow by means of the particle-stream feed line 21 and the turbostub 20, are conveyed into the inlet 41 both by the additional orientation in the direction of the blasting-nozzle outlet 42 of the blasting nozzle 40 and by the action of the compressed-gas stream 13 emerging from the compressed-gas ultrasonic nozzle 10, executing a rotational flow about the axis of rotation 50. During this movement, the reduction of the rotational diameter increases the angular velocity of the $CO_2$ dry ice particles 22. At the same time, the action of the compressed-gas stream 13 emerging from the compressed-gas ultrasonic nozzle 10 results in an axial acceleration which reaches its maximum in the neck-diameter 43, so that maximum velocities occur In the blasting-nozzle outlet 42. The two-phase gas-particle jet emerging from the blasting-nozzle outlet 42 is in this case formed in such a way that the solid-phase $CO_2$ dry ice particles 22 are arranged in a uniform ring shape with an enlarged external diameter.

Figure 2:
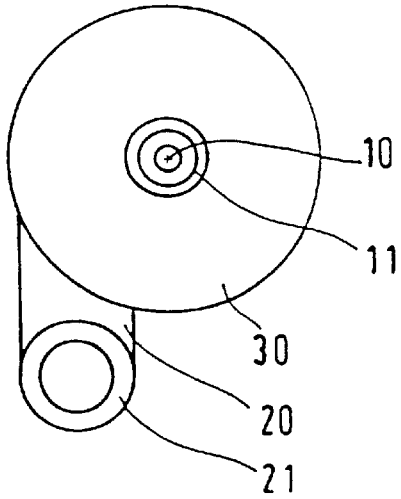
FIG. 2 shows the device in accordance with FIG. 1 in a view from behind.

FIG. 2 shows a rear view of the device for treating surfaces in accordance with FIG. 1.

Figure 3:
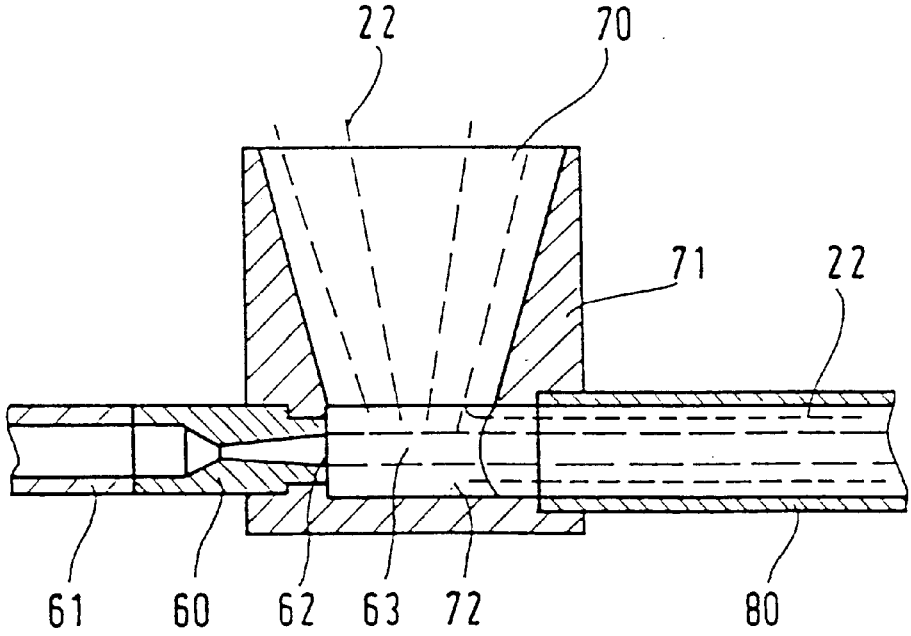
FIG. 3 shows a ultrasonic transport ejector for feeding $CO_2$ dry ice particles to a device in accordance with FIG. 1, in longitudinal section.

FIG. 3 shows a preferred ultrasonic transport ejector for supplying $CO_2$ dry ice particles 22. This ejector is arranged at the outlet of a reservoir (not shown) for $CO_2$ dry ice particles 22 which are stored or are produced just in time, the inlet funnel housing 71 of which reservoir has an internal conical inlet funnel 70 with a cylindrical end chamber 72, the inlet funnel housing 71 being connected, on the one hand, to a compressed carrier-gas feed line 61 for a compressed carrier gas which is at relatively high pressure, and a convergent/divergent compressed carrier-gas ultrasonic nozzle 60 which is connected thereto and, on the other hand, to an outlet stub 80. Outlet stub 80 and particle-stream feed line 21 are connected, for example by means of a hose (not shown), and have approximately the same nominal width. The internal diameter of the end chamber 72 preferably corresponds to 1 to 3 times the nominal width of the outlet stub 80.

The compressed carrier-gas ultrasonic nozzle 60 has a neck diameter of 2 mm and a diameter of 3.5 mm at its outlet 62. At a pressure of 15 bar, the compressed carrier-gas ultrasonic nozzle 60 is configured for a compressed carrier-gas flow rate of 32 $m^3/h$, i.e. approx. 10% of the total compressed gas volume.

By means or a compressed carrier-gas stream 63 generated in the compressed carrier-gas ultrasonic nozzle 60, the $CO_2$ dry ice particles 22, following an extreme initial acceleration in the region of the outlet stub 80, are accelerated on average to a final speed of 50–100 m/s, at which they leave the turbostub 20 tangentially and pass into the interior of the blasting chamber 30. This represents an approximately four-fold increase of the particle speed by comparison with free suction, and overall leads to the surface performance being doubled for an identical consumption of $CO_2$ dry ice particles 22 and compressed gas.

In a further variant (not shown) of a blasting chamber, the compressed-gas feed line 11 and the particle-stream feed line 21 are produced closely parallel to one another and from rigid material over a length of 0.3 to 3 m, preferably approximately 1.5 m, and at their ends each have connections for movable hoses.

When designed in this way, a device for treating surfaces by means of $CO_2$ dry ice particles 22 represents a novel blasting lance which is suitable advantageously for treating surfaces of floors, ceilings, walls and other relatively large elements. The advantage of this design lies in the ergonomically optimum absorption of recoil and the avoidance of enforced physical positions when handling the device.

In a further design (not shown), the axes of the compressed-gas feed line 11 and of the particle-stream feed line 21 are bent in such a way that it is possible to treat even corners and angles which are difficult to gain access to.

What is claimed is:

1. Device for treating surfaces by means of particles, using a two-phase gas-particle jet, comprising at least one turbostub for the supply of particles arranged on a housing of a blasting chamber, which turbostub leads tangentially into the blasting chamber and has an additional-axial orientation in a direction of an outlet of a blasting nozzle, the blasting nozzle being provided with an essentially conical inlet, an inlet angle of which is in total less than 120°, wherein a compressed-gas feed line and a particle-stream feed line are produced parallel to one another from solid material over a length of 0.3 to 3 m, with axes of the feed lines being made either straight or bent.

2. Device for treating surfaces by means of particles, using a two-phase gas-particle jet, comprising at least one turbostub for the supply of particles arranged on a housing of a blasting chamber, which turbostub leads tangentially into the blasting chamber and has an additional axial orientation in a direction of an outlet of a blasting nozzle, the blasting nozzle being provided with an essentially conical inlet, an inlet angle of which is in total less than 120°, wherein a reservoir for the particles is connected to a ultrasonic transport ejector, an inlet funnel housing of which is connected to a compressed carrier-gas feed line for compressed carrier gas which is at a relatively high pressure, and to an outlet stub connected by means of a hose to the blasting chamber, the outlet stub and a particle-stream feedline having approximately the same nominal width.

3. Device for treating surfaces by means of particles, using a two-phase gas-particle jet, comprising at least one turbostub for the supply of particles arranged on a housing of a blasting chamber, which turbostub leads tangentially into the blasting chamber and has an additional axial orientation in a direction of an outlet of a blasting nozzle, the blasting nozzle being provided with an essentially conical inlet, an inlet angle of which is in total less than 120°, wherein a compressed carrier-gas feed line is connected to a convergent/divergent compressed carrier-gas ultrasonic nozzle, an outlet of which ends at a wall of an end chamber at an end of an inlet funnel housing, an internal diameter of the end chamber preferably corresponding to 1 to 3 times a nominal width of an outlet stub.

4. Device for treating surfaces by means of particles, using a two-phase gas-particle jet, comprising at least one turbostub for the supply of particles arranged on a housing of a blasting chamber, which turbostub leads tangentially into the blasting chamber and has an additional axial orientation in a direction of an outlet of a blasting nozzle, the blasting nozzle being provided with an essentially conical inlet, an inlet angle of which is in total less than 120°, wherein the blasting chamber is of cylindrical design in a region of an entry of the turbostub, an axial length of the blasting chamber corresponding to at least a diameter of the turbostub, and wherein a compressed-gas feed line and a particle-stream feed line are produced parallel to one another from solid material over a length of 0.3 to 3 m, with the axes of the feed lines being made either straight or bent.

5. Device for treating surfaces by means of particles, using a two-phase gas-particle jet, comprising at least one turbostub for the supply of particles arranged on a housing of a blasting chamber, which turbostub leads tangentially into the blasting chamber and has an additional axial orientation in a direction of an outlet of a blasting nozzle, the blasting nozzle being provided with an essentially conical inlet, an inlet angle of which is in total less than 120°, wherein the blasting chamber is of cylindrical design in a region of an entry of the turbostub, an axial length of the blasting chamber corresponding to at least a diameter of the turbostub, and wherein a reservoir for the particles is connected to a ultrasonic transport ejector, an inlet funnel housing of which is connected to a compressed carrier-gas feed line for compressed carrier gas which is at a relatively high pressure, and to an outlet stub connected by means of a hose to the blasting chamber, the outlet stub and a particle-stream feed line having approximately the same nominal width.

6. Device for treating surfaces by means of particles, using a two-phase gas-particle jet, comprising at least one turbostub for the supply of particles arranged on a housing of a blasting chamber, which turbostub leads tangentially into the blasting chamber and has an additional axial orientation in a direction of an outlet of a blasting nozzle, the blasting nozzle being provided with an essentially conical inlet, an inlet angle of which is in total less than 120°, wherein the blasting chamber is of cylindrical design in a region of an entry of the turbostub, an axial length of the blasting chamber corresponding to at least a diameter of the turbostub, and wherein a compressed carrier-gas feed line is connected to a convergent/divergent compressed carrier-gas ultrasonic nozzle, an outlet of which ends at a wall of an end chamber at an end of an inlet funnel housing, an internal diameter of the end chamber preferably corresponding to 1 to 3 times a nominal width of an outlet stub.

7. Device for treating surfaces by means of particles, using a two-phase gas-particle jet, comprising at least one turbostub for the supply of particles arranged on a housing of a blasting chamber, which turbostub leads tangentially into the blasting chamber and has an additional axial orientation in a direction of an outlet of a blasting nozzle, the blasting nozzle being provided with an essentially conical inlet, an inlet angle of which is in total less than 120°, wherein an internal diameter of the blasting chamber corresponds to at least 1.5 times the diameter of the turbostub, and wherein a compressed-gas feed line and a particle-stream feed line are produced parallel to one another from solid material over a length of 0.3 to 3 m, with axes of the feed lines being made either straight or bent.

8. Device for treating surfaces by means of particles, using a two-phase gas-particle jet, comprising at least one turbostub for the supply of particles arranged on a housing of a blasting chamber, which turbostub leads tangentially into the blasting chamber and has an additional axial orientation in a direction of an outlet of a blasting nozzle, the blasting nozzle being provided with an essentially conical inlet, an inlet angle of which is in total less than 120°, wherein an internal diameter of the blasting chamber corresponds to at least 1.5 times the diameter of the turbostub, and wherein a reservoir for the particles is connected to a ultrasonic transport ejector, an inlet funnel housing of which is connected to a compressed carrier-gas feed line for compressed carrier gas which is at a relatively high pressure, and to an outlet stub connected by means of a hose to the blasting chamber, the outlet stub and a particle-stream feed line having approximately the same nominal width.

9. Device for treating surfaces by means of particles, using a two-phase gas-particle jet, comprising at least one turbostub for the supply of particles arranged on a housing of a blasting chamber, which turbostub leads tangentially into the blasting chamber and has an additional axial orientation in a direction of an outlet of a blasting nozzle, the blasting nozzle being provided with an essentially conical inlet, an inlet angle of which is in total less than 120°, wherein an internal diameter of the blasting chamber corresponds to at least 1.5 times the diameter of the turbostub, and wherein a compressed carrier-gas feed line is connected to a convergent/divergent compressed carrier-gas ultrasonic nozzle, an outlet of which ends at a wall of an end chamber at an end of an inlet funnel housing, an internal diameter of the end chamber corresponding to 1 to 3 times a nominal width of an outlet stub.

10. Device according to claim 1, wherein a reservoir for the particles is connected to a ultrasonic transport ejector, an inlet funnel housing of which is connected to a compressed carrier-gas feed line for compressed carrier gas which is at a relatively high pressure, and to an outlet stub connected by means of a hose to the blasting chamber, the outlet stub and the particle-stream feed line having approximately the same nominal width.

11. Device according to claim 1, wherein the compressed carrier-gas feed line is connected to a convergent/divergent compressed carrier-gas ultrasonic nozzle, an outlet of which ends at a wall of an end chamber at an end of an inlet funnel housing, an internal diameter of the end chamber corresponding to 1 to 3 times a nominal width of an outlet stub.

12. Device for treating surfaces by means of particles, using a two-phase gas-particle jet, comprising at least one turbostub for the supply of particles arranged on a housing of a blasting chamber, which turbostub leads tangentially into the blasting chamber and has an additional axial orientation in a direction of an outlet of a blasting nozzle, the blasting nozzle being provided with an essentially conical inlet, an inlet angle of which is in total less than 120°, wherein the blasting chamber is of cylindrical design in a region of an entry of the turbostub, an axial length of the blasting chamber corresponding to at least a diameter of the turbostub, and wherein a compressed carrier-gas feed line is connected to a convergent/divergent compressed carrier-gas ultrasonic nozzle, an outlet of which ends at a wall of an end chamber at an end of an inlet funnel housing, an internal diameter of the end chamber corresponding to 1 to 3 times a nominal width of an outlet stub.

13. Device according to claim 4, wherein the compressed-gas feed line (11) and the particle-streamline (21) are produced parallel to one another from solid material over a length of approximately 1.5 m.

14. Device according to claim 1, wherein the compressed-gas feed line and the particle-stream feed line are produced parallel to one another from solid material over a length of approximately 1.5 m.

15. Device for treating surfaces by means of particles, using a two-phase gas-particle jet, comprising at least one turbostub for the supply of gas and/or particles arranged on a housing of a blasting chamber, which turbostub leads tangentially into the blasting chamber and has an additional axial orientation in the direction of the an outlet of a blasting nozzle, the blasting nozzle being provided with an essentially conical inlet, an inlet angle of which is in total less than 120°, wherein a reservoir for the particles is connected to a ultrasonic transport ejector, an inlet funnel housing of which is connected to a compressed carrier-gas feed line for compressed carrier gas which is at a relatively high pressure, and to an outlet stub connected by means of a hose to the blasting chamber, the outlet stub and a particle-stream feed line having approximately the same nominal width.

* * * * *